US006838662B2

(12) United States Patent
Bateman et al.

(10) Patent No.: US 6,838,662 B2
(45) Date of Patent: Jan. 4, 2005

(54) MASS SPECTROMETER

(75) Inventors: Robert Harold Bateman, Knutsford (GB); Kevin Giles, Altrincham (GB); John Brian Hoyes, Stockport (GB); Steve Pringle, Hoddlesden (GB); Jason Lee Wildgoose, Stockport (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/693,874

(22) Filed: Oct. 28, 2003

(65) Prior Publication Data

US 2004/0124354 A1 Jul. 1, 2004

Related U.S. Application Data

(60) Provisional application No. 60/426,378, filed on Nov. 15, 2002.

(30) Foreign Application Priority Data

Nov. 8, 2002 (GB) ..... 0226017

(51) Int. Cl.[7] ..... H01J 49/00; H01J 49/26

(52) U.S. Cl. ..... 250/286; 250/281; 250/282; 250/283; 250/287; 250/288

(58) Field of Search ..... 250/281, 282, 250/283, 286, 287, 288

(56) References Cited

U.S. PATENT DOCUMENTS

| | | | | |
|---|---|---|---|---|
| 5,140,158 | A | 8/1992 | Post | |
| 2004/0031920 | A1 * | 2/2004 | Giles et al. | 250/287 |

FOREIGN PATENT DOCUMENTS

| | | |
|---|---|---|
| GB | 2 392 006 | 2/2004 |
| GB | 2 392 306 | 2/2004 |
| GB | 2 392 548 | 3/2004 |
| WO | WO 94/01883 | 1/1994 |

OTHER PUBLICATIONS

Schwager et al., "The Solitron—A New Spectrometer That Uses the Mass Selectivity of a Solitary, Traveling Electric Potential Hill", 42$^{nd}$ ASMS Conference on Mass Spectrometry, pp. 512, 1994.

* cited by examiner

*Primary Examiner*—Nikita Wells
(74) *Attorney, Agent, or Firm*—Diederiks & Whitelaw, PLC

(57) ABSTRACT

A mass spectrometer is disclosed comprising a mass filter for separating ions according to their mass to charge ratio. The mass filter comprises a plurality of electrodes wherein ions are radially confined within the mass filter by the application of AC or RF voltages to the electrodes. One or more transient DC voltages or one or more transient DC voltage waveforms are progressively applied to the electrodes so that ions having a certain mass to charge ratio are separated from other ions having different mass to charge ratios which remain radially confined within the mass filter.

123 Claims, 5 Drawing Sheets

RF Polarity
+-+-+-

MASS SPECTROMETER

CROSS-REFERENCE TO RELATED APPLICATION

This application claims the benefit of the filing of U.S. Provisional Patent Application Ser. No. 60/426,378 filed Nov. 15, 2002.

BACKGROUND OF THE INVENTION

1. Field of the Invention

The present invention relates to a mass spectrometer, a mass filter, a method of mass spectrometry and a method of mass to charge ratio separation.

2. Discussion of the Prior Art

Radio Frequency (RF) ion guides are commonly used for confining and transporting ions. Conventional RF ion guides use an arrangement of electrodes wherein an RF voltage is applied to neighbouring electrodes so that a radial pseudo-potential well or valley is generated in order to radially confine ions within the ion guide. Conventional RF ion guides include quadrupole, hexapole and octapole rod sets. Ion tunnel ion guides are also known which comprise a plurality of stacked rings or electrodes having apertures through which ions are transmitted and wherein opposite phases of an RF voltage supply are applied to adjacent rings.

In addition to ion guides per se, 2D and 3D quadrupole ion traps and quadrupole rod set mass filters are known. Quadrupole rod set mass filters comprise four rod electrodes wherein diametrically opposed rods are maintained at the same AC and DC potential. Adjacent or neighbouring rods are supplied with opposite phases of an AC voltage supply. A DC potential difference is maintained between adjacent rods when the set is operated in a mass filtering mode. Ions having specific mass to charge ratios are arranged to pass through the quadrupole rod set mass filter with substantially stable trajectories. However, all other ions are arranged so as to have substantially unstable trajectories as they pass through the quadrupole rod set mass filter. Those ions which have unstable trajectories are not radially confined within the quadrupole mass filter and will therefore, most likely, hit one of the rods and be lost. Conventional quadrupole rod set mass filters therefore suffer from the problem that although they may transmit specific ions having normally a relatively narrow or specific range of mass to charge ratios with a high transmission efficiency, all other ions will be lost. Furthermore, conventional quadrupole rod set mass filters are also normally relatively long and this makes the miniaturisation of mass spectrometers problematic.

It is therefore desired to provide an improved mass filter for use in a mass spectrometer.

SUMMARY OF THE INVENTION

According to the present invention there is provided a mass spectrometer comprising:

a mass filter for separating ions according to their mass to charge ratio, the mass filter comprising at least seven electrodes wherein, in use, an Ac or RF voltage is applied to the electrodes in order to radially confine ions within the mass filter and wherein in use one or more transient DC voltages or one or more transient DC voltage waveforms are progressively applied to the electrodes so that at least some ions having a first mass to charge ratio are separated from other ions having a second different mass to charge ratio which remain substantially radially confined within the mass filter.

Conventional quadrupole rod set mass filters/analysers are not intended to fall within the scope of protection afforded by the present invention. In particular, conventional quadrupole rod set mass filters/analysers comprise four electrodes and ions which are not passed by the mass filter are not radially confined within the mass filter/analyser but are lost to the electrodes. Conventional 2D and 3D quadrupole ion traps are also not intended to fall within the scope of protection afforded by the present invention.

A mass filter according to the preferred embodiment is particularly advantageous compared with a conventional quadrupole mass filter in that the preferred mass filter preferably has a high duty cycle across a wide mass to charge ratio range and also enables ions to be ejected on a flexible timescale. The preferred mass filter can also operate with duty cycles up to 100% since it is possible to eject only those ions having a desired mass to charge ratio whilst all other ions preferably remain stored, trapped or otherwise radially confined within the mass filter for subsequent mass filtering or analysis.

The preferred embodiment preferably also has a folded geometry so that ions may be sent backwards and forwards through the mass filter so that a relatively compact mass filter is provided. This arrangement also facilitates band-pass modes of operation.

The preferred mass filter also exhibits a higher sensitivity compared with conventional quadrupole mass filters.

According to an embodiment a repeating pattern of electrical DC potentials are preferably superimposed along the length of the mass filter so that a periodic DC voltage waveform is provided. The DC voltage waveform may be caused to travel along the length of the mass filter in the direction in which it is required to move the ions and at a velocity at which it is required to move the ions.

The mass filter may comprise an AC or RF ion guide such as preferably a stacked ring set (or ion tunnel ion guide) or less preferably a segmented multipole rod set. The preferred mass filter is preferably segmented in the axial direction so that independent transient DC potentials may be applied to each segment. The transient DC potentials are preferably superimposed on top of an AC or RF voltage (which acts to radially confine ions) and/or any constant DC offset voltage. The transient DC potential or waveform generates a DC potential or waveform which may be considered to effectively move along the mass filter in the axial direction.

At any instant in time an axial voltage gradient is preferably generated between segments which acts to push or pull ions in a certain direction. As the ions move in the required direction the voltage gradient similarly moves as the transient DC potential (s) are progressively applied or switched to successive electrodes. The individual DC voltages on each of the segments are preferably programmed to create a required DC voltage waveform. The individual DC voltages on each of the segments may also be programmed to change in synchronism so that a DC potential waveform is maintained but is translated in the direction in which it is required to move the ions.

The mass filter is preferably maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar. The mass filter is preferably maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv)

less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar. The mass filter may be maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

The one or more transient DC voltages or one or more transient DC voltage waveforms is preferably such that at least 10%, 20%, 30%, 40%, 50%, 60%, 70%, 80%, 90% or 95% of the ions having the first mass to charge ratio are substantially moved along the mass filter by the one or more transient DC voltages or the one or more transient DC voltage waveforms as the one or more transient DC voltages or the one or more transient DC voltage waveforms are progressively applied to the electrodes.

The one or more transient DC voltages or the one or more transient DC voltage waveforms are preferably such that at least 10%, 20%, 30%, 40%, 50%, 60%, 70%, 80%, 90% or 95% of the ions having the second mass to charge ratio are moved along the mass filter by the applied DC voltage to a lesser degree than the ions having the first mass to charge ratio as the one or more transient DC voltages or the one or more transient DC voltage waveforms are progressively applied to the electrodes.

The one or more transient DC voltages or the one or more transient DC voltage waveforms are preferably such that at least 10%, 20%, 30%, 40%, 50%, 60%, 70%, 80%, 90% or 95% of the ions having the first mass to charge ratio are moved along the mass filter with a higher velocity than the ions having the second mass to charge ratio.

According to another aspect of the present invention there is provided a mass spectrometer comprising:

a mass filter for separating ions according to their mass to charge ratio, the mass filter comprising at least seven electrodes wherein, in use, an AC or RF voltage is applied to the electrodes in order to radially confine ions within the mass filter and wherein in use one or more transient DC voltages or one or more transient DC voltage waveforms are progressively applied to the electrodes so that ions are moved towards a region of the mass filter wherein at least one electrode has a potential such that at least some ions having a first mass to charge ratio will pass across the potential whereas other ions having a second different mass to charge ratio will not pass across the potential but will remain substantially radially confined within the mass filter.

The one or more transient DC voltages or the one or more transient DC voltage waveforms are preferably such that at least 10%, 20%, 30%, 40%, 50%, 60%, 70%, 80%, 90% or 95% of the ions having the first mass to charge ratio pass across the potential. The one or more transient DC voltages or the one or more transient DC voltage waveforms are such that at least 10%, 20%, 30%, 40%, 50%, 60%, 70%, 80%, 90% or 95% of the ions having the second mass to charge ratio will not pass across the potential. The at least one electrode is preferably provided with a voltage such that a potential hill or valley is provided. Some ions will be able to pass through or across the potential hill or valley whereas other ions will be substantially prevented from passing through or across the potential hill or valley.

The one or more transient DC voltages or the one or more transient DC voltage waveforms are preferably such that at least 10%, 20%, 30%, 40%, 50%, 60%, 70%, 80%, 90% or 95% of the ions having the first mass to charge ratio exit the mass filter substantially before ions having the second mass to charge ratio. The one or more transient DC voltages or the one or more transient DC voltage waveforms are preferably such that at least 10%, 20%, 30%, 40%, 50%, 60%, 70%, 60%, 90% or 95% of the ions having the second mass to charge ratio exit the mass filter substantially after ions having the first mass to charge ratio.

A majority of the ions having the first mass to charge ratio preferably exit the mass filter a time t before a majority of the ions having the second mass to charge ratio exit the mass filter, wherein t falls within a range selected from the group consisting of: (i) <1 $\mu$s; (ii) 1–10 $\mu$s; (iii) 10–50 $\mu$s; (iv) 50–100 $\mu$s; (v) 100–200 $\mu$s; (vi) 200–300 $\mu$s; (vii) 300–400 $\mu$s; (viii) 400–500 $\mu$s; (ix) 500–600 $\mu$s; (x) 600–700 $\mu$s; (xi) 700–800 $\mu$s; (xii) 800–900 $\mu$s; (xiii) 900–1000 $\mu$s;

According to another embodiment t falls within a range selected from the group consisting of: (i) 1.0–1.5 ms; (ii) 1.5–2.0 ms; (iii) 2.0–2.5 ms; (iv) 2.5–3.0 ms; (v) 3.0–3.5 ms; (vi) 3.5–4.0 ms; (vii) 4.0–4.5 ms; (viii) 4.5–5.0 ms; (ix) 5–10 ms; (x) 10–15 ms; (xi) 15–20 ms; (xii) 20–25 ms; (xiii) 25–30 ms; (xiv) 30–35 ms; (xv) 35–40 ms; (xvi) 40–45 ms; (xvii) 45–50 ms; (xviii) 50–55 ms; (xix) 55–60 ms; (xx) 60–65 ms; (xxi) 65–70 ms; (xxii) 70–75 ms; (xxiii) 75–80 ms; (xxiv) 80–85 ms; (xxv) 85–90 ms; (xxvi) 90–95 ms; (xxvii) 95–100 ms; and (xxviii) >100 ms.

According to another aspect of the present invention there is provided a mass spectrometer comprising:

a mass filter for separating ions according to their mass to charge ratio, the mass filter comprising a plurality of electrodes wherein, in use, an AC or RF voltages is applied to the electrodes in order to radially confine ions with the mass filter and wherein in use one or more transient DC voltages or one or more transient DC voltage waveforms are progressively applied to the electrodes so that:

(i) ions are moved towards a region of the mass filter wherein at least one electrode has a first potential such that at least some ions having first and second different mass to charge ratios will pass across the first potential whereas other ions having a third different mass to charge ratio will not pass across the first potential; and then (ii) ions having the first and second mass to charge ratios are moved towards a region of the mass filter wherein at least one electrode has a second potential such that at least some ions having the first mass to charge ratio will pass across the second potential whereas other ions having the second different mass to charge ratio will not pass across the second potential.

The one or more transient DC voltages or the one or more transient DC voltage waveforms and the first potential are preferably such that at least 10%, 20%, 30%, 40%, 50%, 60%, 70%, 80%, 90% or 95% of the ions having the first mass to charge ratio pass across the first potential. The one or more transient DC voltages or the one or more transient DC voltage waveforms and the first potential are preferably such that at least 10%, 20%, 30%, 40%, 50%, 60%, 70%, 80%, 90% or 95% of the ions having the second mass to charge ratio pass across the first potential. The one or more transient DC voltages or the one or more transient DC voltage waveforms and the first potential are preferably such that at least 10%, 20%, 30%, 40%, 50%, 60%, 70%, 80%, 90% or 95% of the ions having the third mass to charge ratio do not pass across the first potential.

The one or more transient DC voltages or the one or more transient DC voltage waveforms and the second potential are preferably such that at least 10%, 20%, 30%, 40%, 50%, 60%, 70%, 80%, 90% or 95% of the ions having the first mass to charge ratio pass across the second potential. The one or more transient DC voltages or the one or more transient DC voltage waveforms and the second potential are preferably such that at least 10%, 20%, 30%, 40%, 50%, 60%, 70%, 80%, 90% or 95% of the ions having the second mass to charge ratio do not pass across the second potential.

The one or more transient DC voltages or the one or more transient DC voltage waveforms are preferably such that at least 10%, 20%, 30%, 40%, 50%, 60%, 70%, 80%, 90% or 95% of the ions having the second mass to charge ratio exit the mass filter substantially before ions having the first and third mass to charge ratios. The one or more transient DC voltages or the one or more transient DC voltage waveforms are preferably such that at least 10%, 20%, 30%, 40%, 50%, 60%, 70%, 80%, 90% or 95% of the ions having the first and third mass to charge ratios exit the mass filter substantially after ions having the second mass to charge ratio.

A majority of the ions having the second mass to charge ratio preferably exit the mass filter a time t before a majority of the ions having the first and third ion mobilities exit the mass filter, wherein t falls within a range selected from the group consisting of: (i) <1 μs; (ii) 1–10 μs; (iii) 10–50 μs; (iv) 50–100 μs; (v) 100–200 μs; (vi) 200–300 μs; (vii) 300–400 μs; (viii) 400–500 μs; (ix) 500–600 μs; (x) 600–700 μs; (xi) 700–800 μs; (xii) 800–900 μs; and (xiii) 900–1000 μs.

According to another embodiment t falls within a range selected from the group consisting of: (i) 1.0–1.5 ms; (ii) 1.5–2.0 ms; (iii) 2.0–2.5 ma; (iv) 2.5–3.0 ms; (v) 3.0–3.5 ms; (vi) 3.5–4.0 ms; (vii) 4.0–4.5 ms; (viii) 4.5–5.0 ms; (ix) 5–10 ms; (x) 10–15 ms; (xi) 15–20 ms; (xii) 20–25 ms; (xiii) 25–30 ms; (xiv) 30–35 ms; (xv) 35–40 ms; (xvi) 40–45 ms; (xvii) 45–50 ms; (xviii) 50–55 ms; (xix) 55–60 ms; (xx) 60–65 ms; (xxi) 65–70 ms; (xxii) 70–75 ms; (xxiii) 75–80 ms; (xxiv) 80–85 ms; (xxv) 85–90 ms; (xxvi) 90–95 ms; (xxvii) 95–100 ms; and (xxviii) >100 ms.

The one or more transient DC voltages may create: (i) a potential hill or barrier; (ii) a potential well; (iii) a combination of a potential hill or barrier and a potential well; (iv) multiple potential hills or barriers; (v) multiple potential wells; or (vi) a combination of multiple potential hills or barriers and multiple potential wells.

The one or more transient DC voltage waveforms preferably comprise a repeating waveform such as a square wave.

The one or more transient DC voltage waveforms preferably create a plurality of potential peaks or wells separated by intermediate regions. The DC voltage gradient in the intermediate regions may be zero or non-zero and may be either positive or negative. The DC voltage gradient in the intermediate regions may be linear or non-linear. For example, the DC voltage gradient in the intermediate regions may increase or decrease exponentially.

The amplitude of the potential peaks or wells may remain substantially constant or the amplitude of the potential peaks or wells may become progressively larger or smaller. The amplitude of the potential peaks or wells may increase or decrease either linearly or non-linearly.

In use an axial DC voltage gradient may be maintained along at least a portion of the length of the mass filter, wherein the axial voltage gradient varies with time.

The mass filter may comprise a first electrode held at a first reference potential, a second electrode held at a second reference potential, and a third electrode held at a third reference potential, wherein at a first time $t_1$ a first DC voltage is supplied to the first electrode so that the first electrode is held at a first potential above or below the first reference potential, at a second later time $t_2$ a second DC voltage is supplied to the second electrode so that the second electrode is held at a second potential above or below the second reference potential, and at a third later time $t_3$ a third DC voltage is supplied to the third electrode so that the third electrode is held at a third potential above or below the third reference potential.

Preferably, at the first time $t_1$ the second electrode is at the second reference potential and the third electrode is at the third reference potential, at the second time $t_2$ the first electrode is at the first potential and the third electrode is at the third reference potential, and at the third time $t_3$ the first electrode is at the first potential and the second electrode is at the second potential.

Alternatively, at the first time $t_1$ the second electrode is at the second reference potential and the third electrode is at the third reference potential, at the second time $t_2$ the first electrode is no longer supplied with the first DC voltage so that the first electrode is returned to the first reference potential and the third electrode is at the third reference potential, and at the third time $t_3$ the first electrode is at the first reference potential the second electrode is no longer supplied with the second DC voltage so that the second electrode is returned to the second reference potential.

The first, second and third reference potentials are preferably substantially the same. Preferably, the first, second and third DC voltages are substantially the same. Preferably, the first, second and third potentials are substantially the same.

The mass filter may comprise 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential. Preferably, a plurality of segments are maintained at substantially the same DC potential. Preferably, each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions are confined radially within the mass filter by an AC or RF electric field. Ions are preferably radially confined within the mass filter in a pseudo-potential well and are moved axially by a real potential barrier or well.

In use one or more additional AC or RF voltage waveforms may be applied to at least some of the electrodes so that ions are urged along at least a portion of the length of the mass filter. Such AC or RF voltage waveforms are additional to the AC or RF voltages which radially confine ions within the mass filter.

The transit time of ions through the mass filter is preferably selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

The mass filter is preferably maintained at a pressure such that substantially no viscous drag is imposed upon ions passing through the mass filter. The mean free path of ions passing through the mass filter is therefore preferably greater, further preferably substantially greater, than the length of the mass filter.

In use the one or more transient DC voltages or the one or more transient DC voltage waveforms are preferably initially provided at a first axial position and are then subsequently provided at second, then third different axial positions along the mass filter.

The one or more transient DC voltages or the one or more transient DC voltage waveforms preferably move from one end of the mass filter to another end of the mass filter so that at least some ions are urged along the mass filter.

The one or more transient DC voltages or the one or more transient DC voltage waveforms preferably have at least 2, 3, 4, 5, 6, 7, 8, 9 or 10 different amplitudes.

The amplitude of the one or more transient DC voltages or the one or more transient DC voltage waveforms may remain substantially constant with time or alternatively the amplitude of the one or more transient DC voltages or the one or more transient DC voltage waveforms may vary with time. For example, the amplitude of the one or more transient DC voltages or the one or more transient DC voltage waveforms may either: (i) increase with time; (ii) increase then decrease with time; (iii) decrease with time; or (iv) decrease then increase with time.

The mass filter may comprise an upstream entrance region, a downstream exit region and an intermediate region, wherein: in the entrance region the amplitude of the one or more transient DC voltages or the one or more transient DC voltage waveforms has a first amplitude, in the intermediate region the amplitude of the one or more transient DC voltages or the one or more transient DC voltage waveforms has a second amplitude, and in the exit region the amplitude of the one or more transient DC voltages or the one or more transient DC voltage waveforms has a third amplitude.

The entrance and/or exit region preferably comprise a proportion of the total axial length of the mass filter selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

The first and/or third amplitudes may be substantially zero and the second amplitude may be substantially non-zero. Preferably, the second amplitude is larger than the first amplitude and/or the second amplitude is larger than the third amplitude.

The one or more transient DC voltages or the one or more transient DC voltage waveforms preferably pass in use along the mass filter with a first velocity. Preferably, the first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

The one or more transient DC voltages or the one or more transient DC voltage waveforms preferably causes at least some ions within the mass filter to pass along the mass filter with a second different velocity. Preferably, the one or more transient DC voltages or the one or more transient DC voltage waveforms causes at least some ions within the mass filter to pass along the mass filter with a third different velocity. Preferably, the one or more transient DC voltages or the one or more transient DC voltage waveforms causes at least some ions within the mass filter to pass along the mass filter with a fourth different velocity. Preferably, the one or more transient DC voltages or the one or more transient DC voltage waveforms causes at least some ions within the mass filter to pass along the mass filter with a fifth different velocity.

The second and/or the third and/or the fourth and/or the fifth velocities are preferably at least 1, 5, 10, 15, 20, 25, 30, 35, 40, 45, 50, 55, 60, 65, 70, 75, 80, 85, 90, 95 or 100 m/s faster or slower than the first velocity.

The first velocity is preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; (xxi) 5000–5250 m/s; (xxii) 5250–5500 m/s; (xxiii) 5500–5750 m/s; (xxiv) 5750–6000 m/s; and (xxv) >6000 m/s. According to a less preferred embodiment the first velocity may be <10 m/s.

The second and/or the third and/or the fourth and/or the fifth different velocities are preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; (xxi) 5000–5250 m/s; (xxii) 5250–5500 m/s; (xxiii) 5500–5750 m/s; (xxiv) 5750–6000 m/s; and (xxv) >6000 m/s. According to a less preferred embodiment the second and/or third and/or fourth and/or fifth velocity may be <10 m/s.

The one or more transient DC voltages or the one or more transient DC voltage waveforms preferably have a frequency, and wherein the frequency: (i) remains substantially constant; (ii) varies; (iii) increases; (iv) increases then decreases; (v) decreases; or (vi) decreases then increases.

The one or more transient DC voltages or the one or more transient DC voltage waveforms preferably have a wavelength, and wherein the wavelength: (i) remains substantially constant; (ii) varies; (iii) increases; (iv) increases then decreases; (v) decreases; or (vi) decreases then increases.

Two or more transient DC voltages or two or more transient DC voltage waveforms may pass simultaneously along the mass filter. The two or more transient DC voltages or the two or more transient DC voltage waveforms may be arranged to move: (i) in the same direction; (ii) in opposite directions; (iii) towards each other; or (iv) away from each other.

The one or more transient DC voltages or the one or more transient DC voltage waveforms may pass along the mass filter and preferably at least one substantially stationary transient DC potential voltage or voltage waveform is provided at a position along the mass filter.

The one or more transient DC voltages or the one or more transient DC voltage waveforms are preferably repeatedly generated and passed in use along the mass filter, and wherein the frequency of generating the one or more transient DC voltages or the one or more transient DC voltage waveforms: (i) remains substantially constant; (ii) varies; (iii) increases; (iv) increases then decreases; (v) decreases; or (vi) decreases then increases.

A continuous beam of ions may be received at an entrance to the mass filter or alternatively packets of ions may be received at the entrance to the mass filter. Pulses of ions preferably emerge from an exit of the mass filter. The mass spectrometer preferably further comprises an ion detector, the ion detector being arranged to be substantially phase locked in use with the pulses of ions emerging from the exit of the mass filter. The mass spectrometer may further comprise a Time of Flight mass analyser comprising an electrode for injecting ions into a drift region, the electrode being arranged to be energised in use in a substantially synchronised manner with the pulses of ions emerging from the exit of the mass filter.

The mass filter is preferably selected from the group consisting of: (i) an ion funnel comprising a plurality of electrodes having apertures therein through which ions are transmitted in use, wherein the diameter of the apertures becomes progressively smaller or larger; (ii) an ion tunnel comprising a plurality of electrodes having apertures therein through which ions are transmitted in use, wherein the diameter of the apertures remains substantially constant; and (iii) a stack of plate, ring or wire loop electrodes.

The mass filter preferably comprises a plurality of electrodes, each electrode having an aperture through which ions are transmitted in use. Each electrode preferably has a substantially circular aperture. Each electrode preferably has a single aperture through which ions are transmitted in use.

The diameter of the apertures of at least 10%, 20%, 30%, 40%, 50%, 60%, 70%, 80%, 90% or 95% of the electrodes forming the mass filter is preferably selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 ma; (viii) less than or equal to 3 mm; (ix) less than or equal to 2 mm; and (x) less than or equal to 1 mm.

At least 10%, 20%, 30%, 40%, 50%, 60%, 70%, 80%, 90% or 95% of the electrodes forming the mass filter preferably have apertures which are substantially the same size or area.

According to a less preferred embodiment the mass filter may comprise a segmented rod set.

The mass filter preferably consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; (xv) more than 150 electrodes; or (xvi) ≧15 electrodes. According to a less preferred embodiment the mass filter may comprise 7–10 electrodes. A mass filter comprising at least 15 electrodes is preferred.

The thickness of at least 10%, 20%, 30%, 40%, 50%, 60%, 70%, 80%, 90% or 95% of the electrodes is preferably selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The mass filter preferably has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

At least 10%, 20%, 30%, 40%, 50%, 60%, 70%, 80%, 90%, or 95% of the electrodes are preferably connected to both a DC and an AC or RF voltage supply. According to the preferred embodiment axially adjacent electrodes are supplied with AC or RF voltages having a phase difference of 180°.

The mass spectrometer may comprise an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI) ion source; (viii) Chemical Ionisation ("CI") ion source; (ix) a Fast Atom Bombardment ("FAB") ion source; and (x) a Liquid Secondary Ions Mass Spectrometry ("LSIMS") ion source. The ion source may be either a continuous or a pulsed ion source.

According to another aspect of the present invention there is provided a mass filter for separating ions according to their mass to charge ratio, the mass filter comprising at least seven electrodes wherein, in use, an AC or RF voltage is applied to the electrodes in order to radially confine ions within the mass filter and wherein in use one or more transient DC voltages or one or more transient DC voltage waveforms are progressively applied to the electrodes so that at least some ions having a first mass to charge ratio are separated from other ions having a second different mass to charge ratio which remain substantially radially confined within the mass filter.

According to another aspect of the present invention there is provided a mass filter for separating ions according to their mass to charge ratio, the mass filter comprising at least seven electrodes wherein, in use, an AC or RF voltage is applied to the electrodes in order to radially confine ions within the mass filter and wherein in use one or more transient DC voltages or one or more transient DC voltage waveforms are progressively applied to the electrodes so that ions are moved towards a region of the mass filter wherein at least one electrode has a potential such that at least some ions having a first mass to charge ratio will pass across the potential whereas other ions having a second different mass to charge ratio will not pass across the potential but will remain substantially radially confined with the mass filter.

According to another aspect of the present invention there is provided a mass filter for separating ions according to their mass to charge ratio, the mass filter comprising a plurality of electrodes wherein, in use, an AC or RF voltage is applied to the electrodes in order to radially confine ions within the mass filter and wherein in use one or more transient DC voltages or one or more transient DC voltage waveforms are progressively applied to the electrodes so that:

(i) ions are moved towards a region of the mass filter wherein at least one electrode has a first potential such that at least some ions having first and second different mass to charge ratios will pass across the first potential whereas other ions having a third different mass to charge ratio will not pass across the first potential; and then (ii) ions having the first and second mass to charge ratios are moved towards a region of the mass filter wherein at least one electrode has a second potential such that at least some ions having the first mass to charge ratio will pass across the second potential whereas other ions having the second different mass to charge ratio will not pass across the second potential.

According to another aspect of the present invention, there is provided a method of mass spectrometry comprising;

receiving ions in a mass filter comprising at least seven electrodes wherein an AC or RF voltage is applied to the electrodes in order to radially confine ions within the mass filter; and progressively applying to the electrodes one or more transient DC voltages or one or more transient DC voltage waveforms so that at least some ions having a first mass to charge ratio are separated from other ions having a second different mass to charge ratio which remain substantially radially confined within the mass filter.

According to another aspect of the present invention there is provided a method of mass spectrometry comprising:

receiving ions in a mass filter comprising at least seven electrodes wherein an AC or RF voltage is applied to the electrodes in order to radially confine ions Within the mass filter; and progressively applying to the electrodes one or more transient DC voltages or one or more transient DC voltage waveforms so that ions are moved towards a region of the mass filter wherein at least one electrode has a potential such that at least some ions having a first mass to charge ratio will pass across the potential whereas other ions having a second different mass to charge ratio will not pass across the potential but will remain substantially radially confined within the mass filter.

According to another aspect of the present invention there is provided a method of mass spectrometry comprising:

receiving ions in a mass filter comprising a plurality of electrodes wherein an AC or RF voltage is applied to the electrodes in order to radially confine ions within the mass filter;

progressively applying to the electrodes one or more transient DC voltages or one or more transient DC voltage waveforms so that ions are moved towards a region of the mass filter wherein at least one electrode has a first potential such that at least some ions having a first and second different mass to charge ratios will pass across the first potential whereas other ions having a third different mass to charge ratio will not pass across the first potential; and then progressively applying to the electrodes one or more transient DC voltages or one or more transient DC voltage waveforms so that ions having the first and second mass to charge ratios are moved towards a region of the mass filter wherein at least one electrode has a second potential such that at least some ions having the first mass to charge ratio will pass across the second potential whereas other ions having the second different mass to charge ratio will not pass across the second potential.

According to another aspect of the present invention there is provided a method of mass to charge ratio separation comprising:

receiving ions in a mass filter comprising at least seven electrodes wherein an AC or RF voltage is applied to the electrodes in order to radially confine ions within the mass filter; and progressively applying to the electrodes one or more transient DC voltages or one or more transient DC voltage waveforms so that at least some ions having a first mass to charge ratio are separated from other ions having a second different mass to charge ratio which remain substantially radially confined within the mass filter.

According to another aspect of the present invention there is provided a method of mass to charge ratio separation comprising:

receiving ions in a mass filter comprising at least seven electrodes wherein an AC or RF voltage is applied to the electrodes in order to radially confine ions within the mass filter; and progressively applying to the electrodes one or more transient DC voltages or one or more transient DC voltage waveforms so that ions are moved towards a region of the mass filter wherein at least one electrode has a potential such that at least some ions having a first mass to charge ratio will pass across the potential whereas other ions having a second different mass to charge ratio will not pass across the potential but will remain substantially radially confined within the mass filter.

According to another aspect of the present invention there is provided a method of mass to charge ratio separation comprising:

receiving ions in a mass filter comprising a plurality of electrodes an AC or RF voltages is applied to the electrodes in order to radially confine ions within the mass filter;

progressively applying to the electrodes one or more transient DC voltages or one or more transient DC voltage waveforms so that ions are moved towards a region of the mass filter wherein at least one electrode has a first potential such that at least some ions having a first and second different mass to charge ratios will pass across the first potential whereas other ions having a third different mass to charge ratio will not pass across the first potential; and then progressively applying to the electrodes one or more transient DC voltages or one or more transient DC voltage waveforms so that ions having the first and second mass to charge ratios are moved towards a region of the mass filter wherein at least one electrode has a second potential such that at least some ions having the first mass to charge ratio will pass across the second potential whereas other ions having the second different mass to charge ratio will not pass across the second potential.

According to another aspect of the present invention there is provided a mass filter wherein ions separate within the mass filter according to their mass to charge ratio and assume different essentially static or equilibrium axial positions along the length of the mass filter. Preferably, ions having mass to charge ratios within a first range are stored in a first axial trapping region whereas ions having mass to charge ratios within a second different range are stored in a second different axial trapping region.

The mass filter preferably comprises a plurality of electrodes wherein, in use, an AC or RF voltage is applied to the electrodes in order to radially confine ions within the mass filter. Preferably, one or more transient DC voltages or one or more transient DC voltage waveforms are progressively applied to the electrodes so as to urge at least some ions in a first direction. Preferably, a DC voltage gradient acts to urge at least some ions in a second direction, the second direction being opposed to the first direction.

The peak amplitude of the one or more transient DC voltages or the one or more transient DC voltage waveforms preferably remains substantially constant or reduces along the length of the mass filter.

The DC voltage gradient may progressively increase along the length of the mass filter.

Once ions have assumed essentially static or equilibrium axial positions along the length of the mass filter at least some of the ions may then be arranged to be moved towards an exit of the mass filter. At least some of the ions may be arranged to be moved towards an exit of the mass filter by: (i) reducing or increasing an axial DC voltage gradient; (ii) reducing or increasing the peak amplitude of the one or more transient DC voltages or the one or more transient DC voltage waveforms; (iii) reducing or increasing the velocity of the one or more transient DC voltages or the one or more transient DC voltage waveforms; or (iv) reducing or increasing the pressure within the mass filter.

According to another aspect of the present invention there is provided a mass spectrometer comprising a mass filter as described above.

According to another aspect of the present invention there is provided a method of mass to charge ratio separation comprising causing ions to separate within a mass filter and assume different essentially static or equilibrium axial positions along the length of the mass filter.

According to another aspect of the present invention there is provided a method of mass spectrometry comprising any of the methods of mass to charge ratio separation as described above.

BEIEF DESCRIPTION OF THE DRAWINGS

Various embodiments of the present invention will now be described, by way of example only, and with reference to the accompanying drawings in which.

Figure 7:
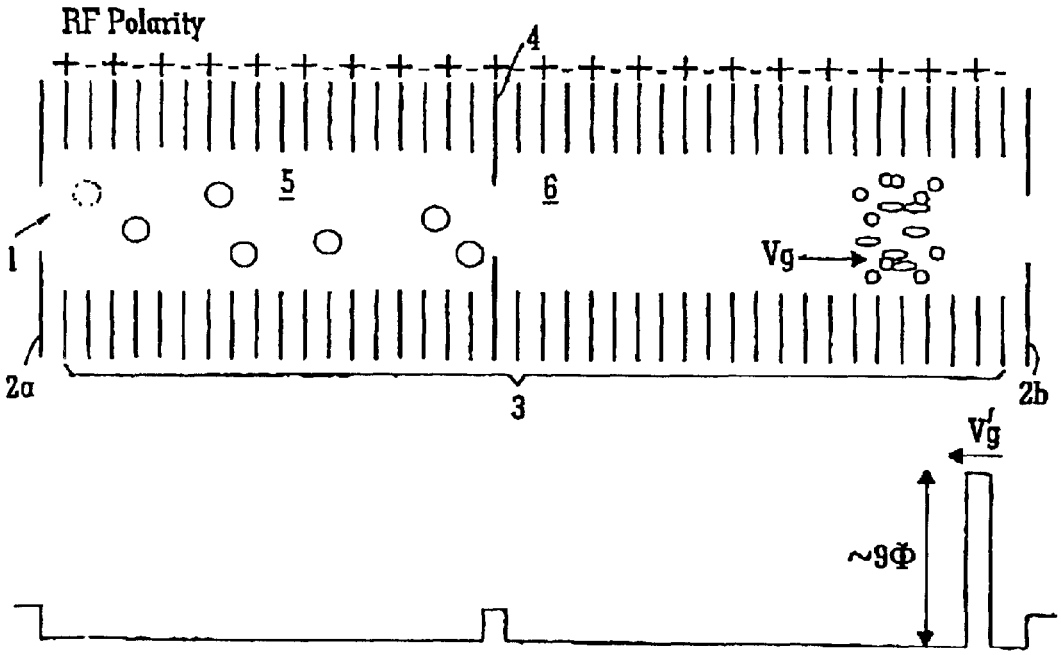
Figure 8:
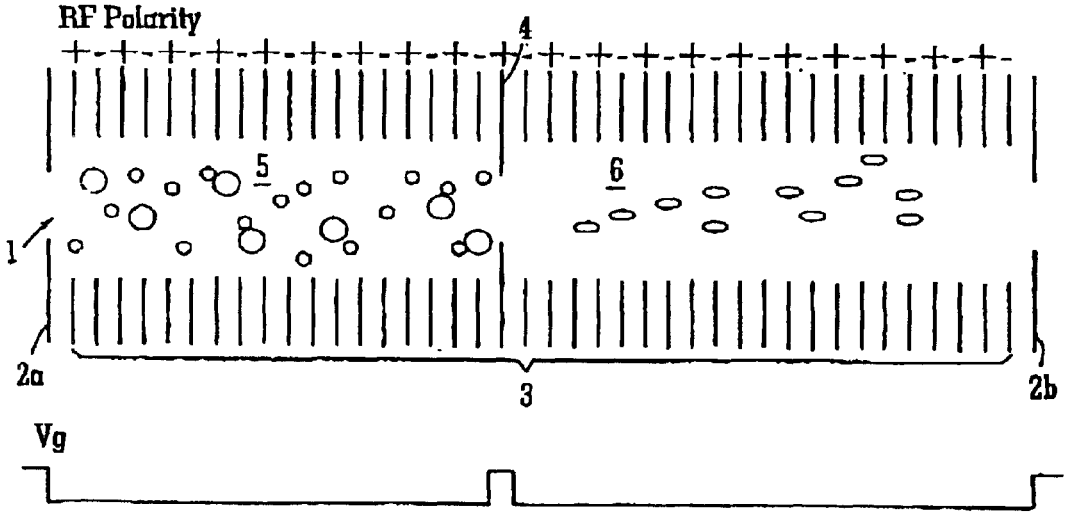

FIG. 7 shows a subsequent stage in a bandpass mode of operation wherein relatively low mass to charge ratio ions which have been swept into a second stage of the mass filter are about to experience a DC potential being applied to electrodes and moving in an opposite direction; and FIG. 8 shows a yet further stage in a bandpass mode of operation wherein ions having an intermediate mass to charge ratio have been separated from ions having relatively higher and lower mass to charge ratios.

DETAILED DESCRIPTION OF THE PREFERRED EMBODIMENTS

According to the preferred embodiment a mass filter comprising an ion tunnel ion guide or less preferably an ion funnel ion guide is provided. Ion tunnel and ion funnel ion guides comprise a plurality of electrodes having apertures through which ions are transmitted in use. With ion tunnel ion guides the size of the apertures are preferably all substantially the same, whereas for ion funnel ion guides the size of the apertures preferably becomes progressively smaller.

Figure 1:
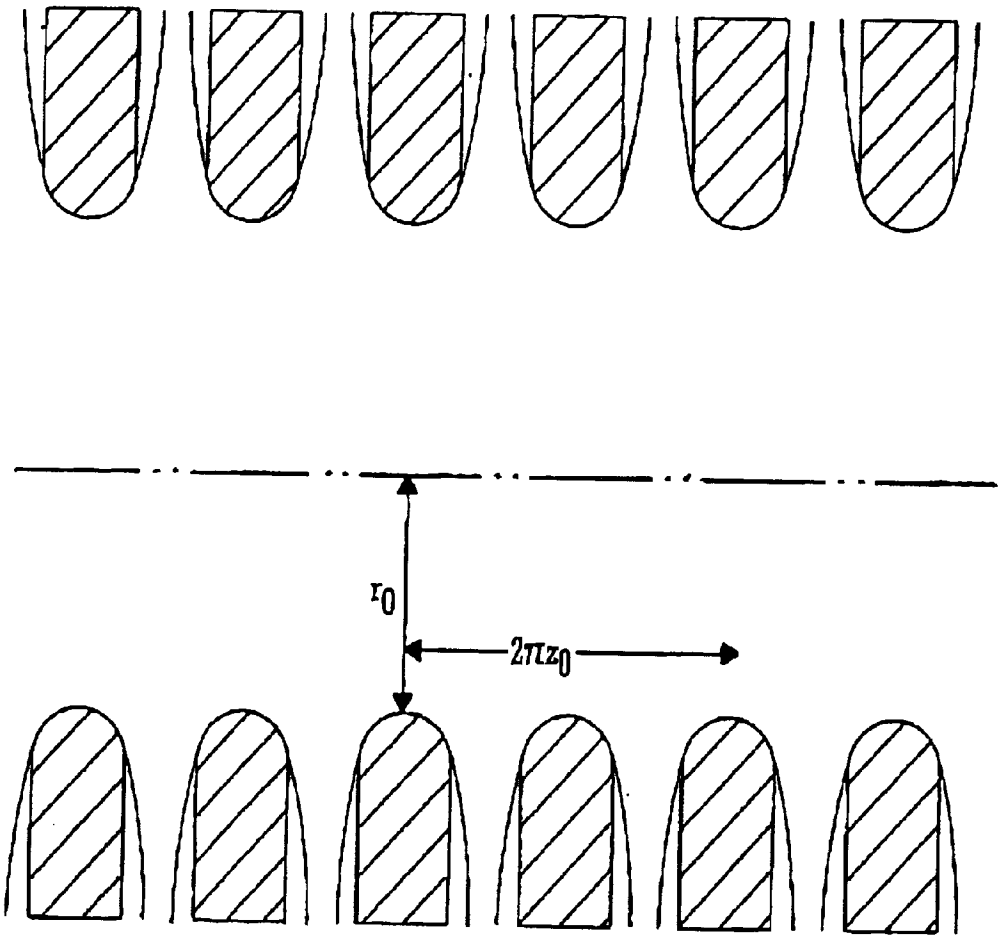
FIG. 1 shows the r and z co-ordinates of a preferred rotationally symmetric ring guide or ion tunnel mass filter.

The application of an AC or RF electric field to the electrodes of an ion tunnel ion guide produces an effective potential which is related to frequency of the radially confining AC or RF voltage and the ion guide geometry itself and is given by:

$$V^* = \frac{q^2 V_o^2}{4m\Omega^2 z_o^2}\left[I_1^2(\hat{r})\cos^2\hat{z} + I_o^2(\hat{r})\sin^2\hat{z}\right] \Big/ I_o^2(\hat{r}_o)$$

$$\hat{r} = r/z_o$$

$$\hat{r}_o = r_o/z_o$$

$$\hat{z}_o = z/z_o$$

where $V_o$ is amplitude of the applied AC or RF voltage, $\Omega$ is the angular frequency of the applied AC or RF voltage, m is the mass of the ion, q is the charge of the ion, and $I_1$ and $I_0$ are modified Bessel functions. The parameters $r_o$ and $z_o$ are shown in more detail in FIG. 1.

The application of an AC or RF voltage to the electrodes of the mass filter is such that adjacent electrodes are preferably held in antiphase. This leads to radial confinement of the ions around the central longitudinal axis.

According to less preferred embodiments the mass filter may comprise, for example, a segmented quadrupole (or other multipole) rod set wherein each segment of the rod set may be maintained at separate DC potentials.

The mass filter is preferably maintained at a pressure such that the probability of an ion experiencing a collision with a gas molecule whilst travelling through the mass filter is substantially negligible. The mass filter is therefore preferably maintained during a mass filtering mode of operation at a pressure $<10^{-4}$ mbar. The mean free path of ions passing through the mass filter when operated in a mass filtering mode of operation is preferably greater or substantially greater than the length of the mass filter. However, gas may have been previously present in the mass filter at pressures $>10^{-4}$ mbar for a sufficient time in order for ions entering the mass filter to have their ion motion collisionally damped so that the ions become thermalised and/or collisionally focussed.

According to the preferred embodiment ions from an ion source, such as for example an Electrospray or MALDI ion source, enter the mass filter and are radially confined therewithin. One or more of the end electrodes 2*a*,2*b* of the mass filter 1 as shown in FIG. 2 are preferably maintained at a slight positive voltage relative to the other electrodes 3 so that negatively charged ions will be effectively trapped axially within the mass filter 1 as they will be unable to surmount the potential barrier at the ends of the mass filter 1.

Figure 2:
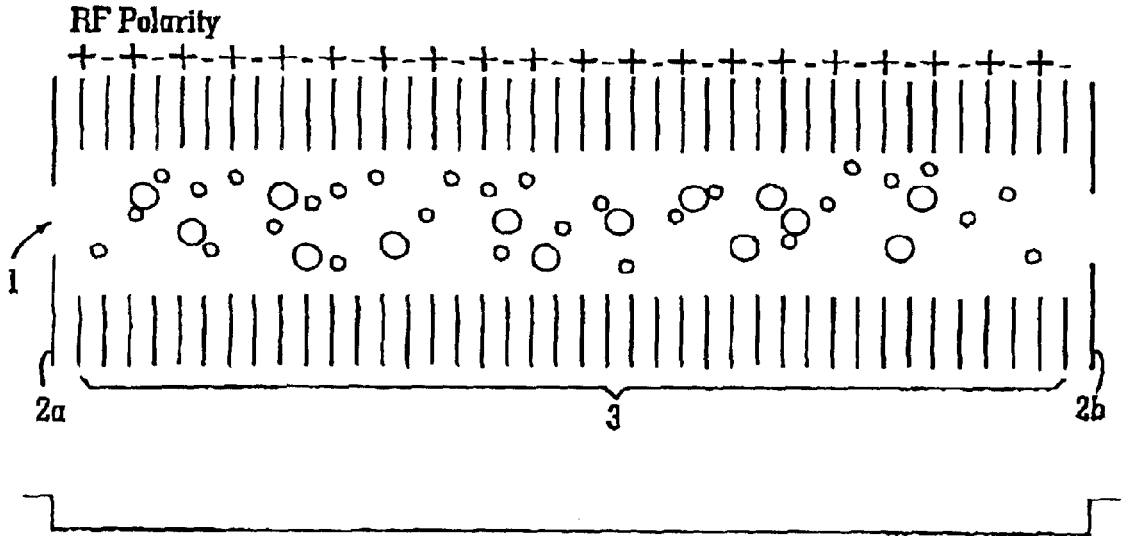
FIG. 2 shows ions having different mass to charge ratios in a state of equilibrium within a preferred ion tunnel mass filter.

After a certain period of time equilibrium will be reached wherein ions having differing mass to charge ratios will be substantially equally distributed throughout the mass filter 1 as shown in FIG. 2. The preferred ion tunnel mass filter 1 comprises a plurality of electrodes 3 each having an aperture through which ions may be transmitted in use. Adjacent electrodes 3 are preferably connected to opposite phases of an AC or RF voltage supply so that ions are radially confined within the mass filter 1 by the resultant pseudo-potential well generated by the AC or RF voltage applied to the electrodes 3. The mass filter 1 is preferably held at a suitably low pressure so that ions traversing the length if the mass filter 1 effectively do not undergo collisions with gas molecules within the mass filter 1. One or more end electrodes 2*a*,2*b* of the mass filter 1 are preferably maintained at a slight positive voltage relative to the other electrodes 3 so that ions once entering the mass filter 1 are effectively trapped within the mass filter 1 and are unable to surmount the potential barrier at one or both ends. After a certain period of time equilibrium may be reached within the mass filter 1 so that ions of all masses and mass to charge ratios are substantially equally distributed along the length of the mass filter 1.

Figure 3:
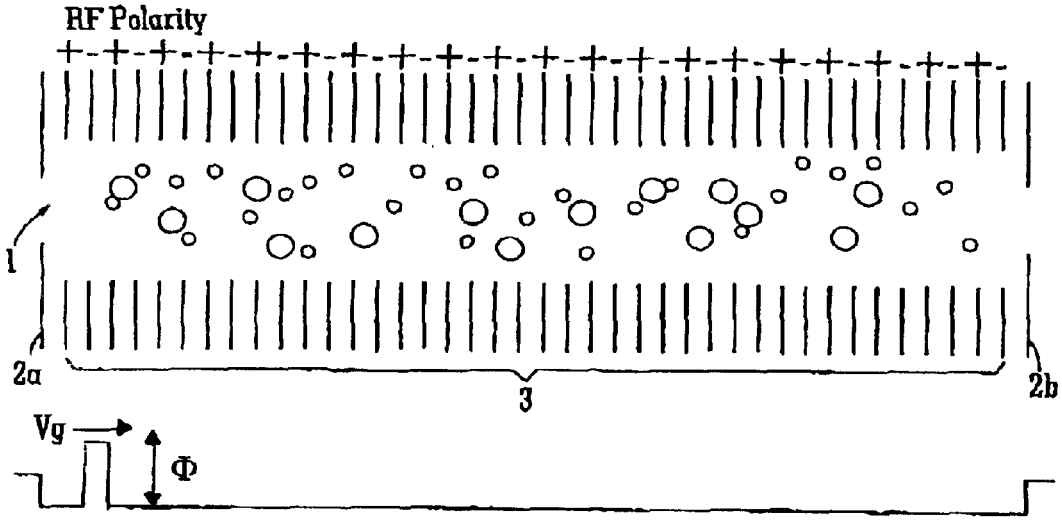
FIG. 3 shows a DC potential being applied to an electrode at one end of the preferred mass filter.

As shown in FIG. 3, according to one embodiment a DC voltage pulse $V_g$ having an amplitude Φ may be applied to the first electrode of the ion guide adjacent to one of the end electrodes 2*a* such that some ions will be accelerated by the applied voltage pulse $V_g$ along the length of the mass filter 1 towards the opposite end. The electric field caused by the applied voltage decays rapidly to a negligible value within a few electrode spacings.

The voltage pulse $V_g$ is then preferably rapidly switched to the next adjacent electrode. An ion which has had enough time to drift at least one electrode spacing will either have been accelerated so that the ion has already made substantial progress along the length of the mass filter 1 or at the very least the ion will have moved sufficiently far so to experience the same force again and hence will continue to move along the length of the mass filter 1 in the direction in which the DC voltage pulse $V_g$ being applied to the electrodes 3 is moving. However, ions having a relatively high mass to charge ratio nay either be substantially unaffected by the electric field or at the very least will not have had sufficient time to have drifted far enough along the length of the mass filter 1 in order to see the influence of the voltage pulse $V_g$ when it switched to the next adjacent electrode. Accordingly, these relatively higher mass to charge ratio ions will be effectively left behind or otherwise substantially unaffected (or at the very least affected to a lesser degree) as the travelling DC voltage pulse $V_g$ or voltage waveform traverses along the length of the mass filter 1.

Figure 4:
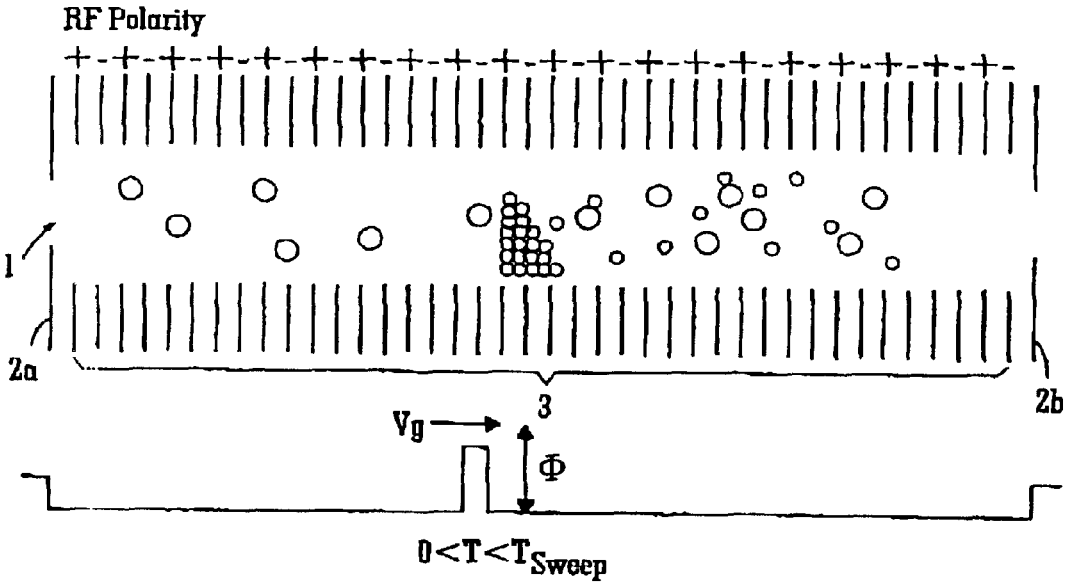
FIG. 4 shows the DC potential being progressively applied to electrodes further along the length of the mass filter and having the effect of sweeping or preferentially accelerating ions having relatively low mass to charge ratios whilst leaving behind or substantially relatively unaffecting ions having relatively higher mass to charge ratios.
Figure 5:
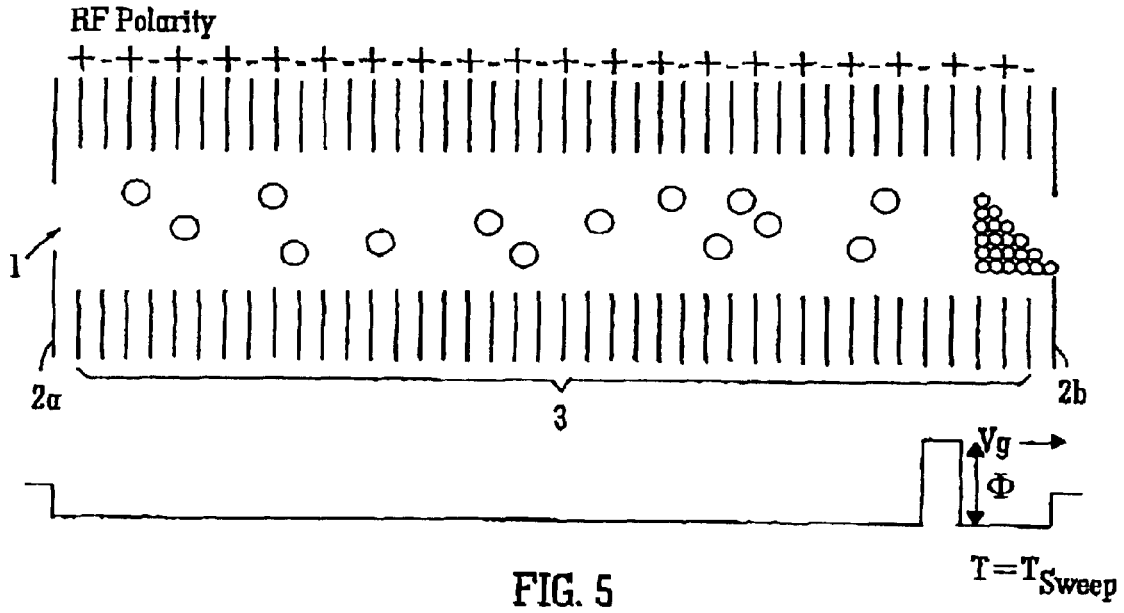
FIG. 5 shows ions which have relatively low mass to charge ratios at the point of being ejected from a mass filter according to the preferred embodiment whilst other ions having relatively higher mass to charge ratios remain trapped within the mass filter.

The DC voltage pulse $V_g$ is preferably progressively switched to the electrodes along the length of the mass filter 1 from electrode to electrode sweeping those ions with a sufficiently low mass to charge ratio with it or accelerating such ions ahead of it. As shown in FIGS. 4 and 5, the mass filter 1 in this mode of operation acts as a low pass mass to charge ratio filter so that ions having mass to charge ratios lower than a certain value may be preferably ejected from the mass filter 1 whereas ions having substantially higher mass to charge ratios preferably remain substantially trapped within the mass filter 1 by the combination of radial confinement due to the AC or RF voltages applied to the electrodes 3 and axial confinement due to one or more DC barrier potentials being applied to one or both of the end electrodes 2*a*,2*b*.

Once a first bunch or group of ions having a relatively low mass to charge ratio have been ejected from the mass filter 1 as shown in FIG. 5, the sweep time $T_{sweep}$ of the DC voltage pulse $V_g$ being applied to the electrodes 3 may then preferably be reduced so that ions having a slightly higher (i.e. intermediate) mass to charge ratio will then be preferentially accelerated. Accordingly, ions having an intermediate mass to charge ratio can then be preferably subsequently ejected from the mass filter 1. By gradually further reducing the sweep time $T_{sweep}$ a complete mass to charge ratio scan can be built up until the mass filter 1 is substantially empty of ions.

According to an alternative and/or additional embodiment, the amplitude of the DC voltage pulse $V_g$ or voltage waveform applied to the electrodes 3 may be progressively increased with each sweep thereby collecting or preferentially accelerating ahead ions having progressively higher mass to charge ratios in substantially the same manner as if the sweep time were increased.

Figure 6:
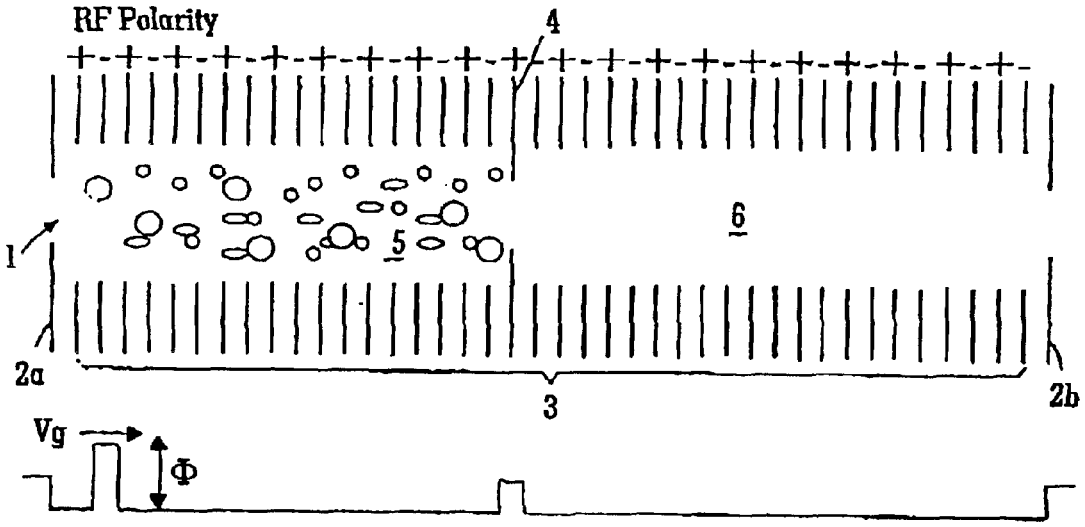
FIG. 6 shows ions at equilibrium in a preferred mass filter being operated in a bandpass mode of operation wherein two or more axial trapping regions are formed along the length of the mass filter.

According to another embodiment a bandpass mode of operation may be performed wherein ions having mass to charge ratios within a particular mass to charge ratio range may be isolated within the mass filter 1 and then subsequently ejected from the mass filter 1 whilst ions having relatively higher and lower mass to charge ratios may remain substantially trapped within the mass filter 1. The bandpass mode of operation is preferably achieved by creating two or more axial trapping regions 5,6 along the length of the mass filter 1 as shown in FIG. 6 by applying a relatively low DC voltage to an electrode 4 at an intermediate position along the length of the mass filter 1. Ions are then preferably swept towards the intermediate electrode 4 by the application of a DC voltage pulse $V_g$ or voltage waveform which is progressively applied to the electrodes in a first axial trapping region 5. As shown in FIG. 7 this will result in ions having mass to charge ratios less than a certain value being swept through the first axial trapping region 5, through or past the intermediate electrode 4 and into a second preferably empty axial trapping region 6. A second travelling DC voltage $V'_g$ or voltage waveform is then preferably applied to the electrodes in the second axial trapping region 6 in the reverse direction so that ions having a relatively low mass to charge ratio are then accelerated or swept back towards the intermediate electrode 4. These low mass to charge ratio ions then preferably pass back into the first axial trapping region 5 whilst ions having a relatively higher mass to charge ratios remain trapped within the second axial trapping region 6. Accordingly, ions having an overall intermediate mass to charge ratio remain in the second axial trapping region as shown in FIG. 8 and can then be ejected from the mass filter 1.

The amplitude of the reverse sweep travelling DC voltage $V'_g$ or voltage waveform is preferably higher than the amplitude of the DC voltage $V_g$ or voltage waveform applied to the electrodes 3 when ions were swept from the first axial trapping region 5 into the second axial trapping region 6. Preferably, the amplitude of the DC voltage $V'_g$ or voltage waveform applied to the electrodes 3 for the reverse sweep is increased by a factor of approximately nine since the relative velocity between the DC voltage $V_g$ or voltage waveform applied to the electrodes 3 and the ions has increased from $v_0$ (the velocity of the DC potential being initially applied to the electrodes) to 3 $v_0$ as the ions are accelerated to 2 $v_0$ during the first pass and are then approached by a second DC potential travelling at a velocity $v_0$ again. The potential required to just prevent an ion from traversing through it is proportional to the relative velocity squared hence the factor of nine.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a mass filter for separating ions according to their mass to charge ratio, said mass filter comprising at least seven electrodes wherein, in use, an AC or RF voltage is applied to said electrodes in order to radially confine ions within said mass filter and wherein in use one or more transient DC voltages or one or more transient DC voltage waveforms are progressively applied to said electrodes so that at least some ions having a first mass to charge ratio are separated from other ions having a second different mass to charge ratio which remain substantially radially confined within said mass filter.

2. A mass spectrometer as claimed in claim 1, wherein said mass filter is maintained, in use, at a pressure selected from the group consisting of: (i) greater than or equal to $1\times10^{-7}$ mbar: (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

3. A mass spectrometer as claimed in claim 1, wherein said mass filter is maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

4. A mass spectrometer as claimed in claim 1, wherein said mass filter is maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-5}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

5. A mass spectrometer as claimed in claim 1, wherein said one or more transient DC voltages or one or more transient DC voltage waveforms is such that at least 10%, 20%, 30%, 40%, 50%, 60%, 70%, 80%, 90% or 95% of said ions having said first mass to charge ratio are substantially moved along said mass filter by said one or more transient DC voltages or said one or more transient DC voltage waveforms as said one or more transient DC voltages or said one or more transient DC voltage waveforms are progressively applied to said electrodes.

6. A mass spectrometer as claimed in claim 1, wherein said one or more transient DC voltages or said one or more transient DC voltage waveforms are such that at least 10%, 20%, 30%, 40%, 50%, 60%, 70%, 80%, 90% or 95% of said ions having said second mass to charge ratio are moved along said mass filter by said applied DC voltage to a lesser degree than said ions having said first mass to charge ratio as said one or more transient DC voltages or said one or more transient DC voltage waveforms are progressively applied to said electrodes.

7. A mass spectrometer as claimed in claim 1, wherein said one or more transient DC voltages or said one or more transient DC voltage waveforms are such that at least 10%, 20%, 30%, 40%, 50%, 60%, 70%, 80%, 90% or 95% of said ions having said first mass to charge ratio are moved along said mass filter with a higher velocity than said ions having said second mass to charge ratio.

8. A mass spectrometer comprising:

an mass filter for separating ions according to their mass to charge ratio, said mass filter comprising at least seven electrodes wherein, in use, an AC or RF voltage is applied to said electrodes in order to radially confine ions within said mass filter and wherein in use one or more transient DC voltages or one or more transient DC voltage waveforms are progressively applied to said electrodes so that ions are moved towards a region of the mass filter wherein at least one electrode has a potential such that at least some ions having a first mass to charge ratio will pass across said potential whereas other ions having a second different mass to charge ratio will not pass across said potential but will remain substantially radially confined within said mass filter.

9. A mass spectrometer as claimed in claim 8, wherein said one or more transient DC voltages or said one or more transient DC voltage waveforms are such that at least 10%, 20%, 30%, 40%, 50%, 60%, 70%, 80%, 90% or 95% of said ions having said first mass to charge ratio pass across said potential.

10. A mass spectrometer as claimed in claim 8, wherein said one or more transient DC voltages or said one or more transient DC voltage waveforms are such that at least 10%, 20%, 30%, 40%, 50%, 60%, 70%, 80%, 90% or 95% of said ions having said second mass to charge ratio will not pass across said potential.

11. A mass spectrometer as claimed in claim 8, wherein said at least one electrode is provided with a voltage such that a potential hill or valley is provided.

12. A mass spectrometer as claimed in claim 8, wherein said one or more transient DC voltages or said one or more transient DC voltage waveforms are such that at least 10%, 20%, 30%, 40%, 50%, 60%, 70%, 80%, 90% or 95% of said ions having said first mass to charge ratio exit said mass filter substantially before ions having said second mass to charge ratio.

13. A mass spectrometer as claimed in claim 8, wherein said one or more transient DC voltages or said one or more transient DC voltage waveforms are such that at least 10%, 20%, 30%, 40%, 50%, 60%, 70%, 80%, 90% or 95% of said ions having said second mass to charge ratio exit said mass filter substantially after ions having said first mass to charge ratio.

14. A mass spectrometer as claimed in claim 8, wherein a majority of said ions having said first mass to charge ratio exit said mass filter a time t before a majority of said ions having said second mass to charge ratio exit said mass filter, wherein t falls within a range selected from the group consisting of: (i) <1 μs; (ii) 1–10 μs; (iii) 10–50 μs; (iv) 50–100 μs; (v) 100–200 μs; (vi) 200–300 μs; (vii) 300–400 μs; (viii) 400–500 μs; (ix) 500–600 μs; (x) 600–700 μa; (xi) 700–800 μs; (xii) 800–900 μa; (xiii) 900–1000 μs.

15. A mass spectrometer as claimed in claim 8, wherein a majority of said ions having said first mass to charge ratio exit said mass filter a time t before a majority of said ions having said second mass to charge ratio exit said mass filter, wherein t falls within a range selected from the group consisting of: (i) 1.0–1.5 ms; (ii) 1.5–2.0 ms; (iii) 2.0–2.5 ms; (iv) 2.5–3.0 ms; (v) 3.0–3.5 ms; (vi) 3.5–4.0 ms; (vii) 4.0–4.5 ms; (viii) 4.5–5.0 ms; (ix) 5–10 ms; (x) 10–15 s; (xi) 15–20 ms; (xii) 20–25 ms; (xiii) 25–30 ms; (xiv) 30–35 ms; (xv) 35–40 ms; (xvi) 40–45 ms; (xvii) 45–50 ms; (xviii) 50–55 ms; (xix) 55–60 ms; (xx) 60–65 ms; (xxi) 65–70 ms; (xxii) 70–75 ms; (xxiii) 75–80 ms; (xxiv) 80–85 ms; (xxv) 85–90 ms; (xxvi) 90–95 ms; (xxvii) 95–100 ms; and (xxviii) >100 ms.

16. A mass spectrometer comprising:

a mass filter for separating ions according to their mass to charge ratio, said mass filter comprising a plurality of electrodes wherein, in use, an AC or RF voltage is applied to said electrodes in order to radially confine ions within said mass filter and wherein in use one or more transient DC voltages or one or more transient DC voltage waveforms are progressively applied to said electrodes so that:

(i) ions are moved towards a region of the mass filter wherein at least one electrode has a first potential such that at least some ions having first and second different mass to charge ratios will pass across said first potential whereas other ions having a third different mass to charge ratio will not pass across said first potential; and then (ii) ions having said first and second mass to charge ratios are moved towards a region of the mass filter wherein at least one electrode has a second potential such that at least some ions having said first mass to charge ratio will pass across said second potential whereas other ions having said second different mass to charge ratio will not pass across said second potential.

17. A mass spectrometer as claimed in claim 16, wherein said one or more transient DC voltages or said one or more transient DC voltage waveforms and said first potential are such that at least 10%, 20%, 30%, 40%, 50%, 60%, 70%, 80%, 90% or 95% of said ions having said first mass to charge ratio pass across said first potential.

18. A mass spectrometer as claimed in claim 16, wherein said one or more transient DC voltages or said one or more transient DC voltage waveforms and said first potential are such that at least 10%, 20%, 30%, 40%, 50%, 60%, 70%, 80%, 90% or 95% of said ions having said second mass to charge ratio pass across said first potential.

19. A mass spectrometer as claimed in claim 16, wherein said one or more transient DC voltages or said one or more transient DC voltage waveforms and said first potential are such that at least 10%, 20%, 30%, 40%, 50%, 60%, 70%, 80%, 90% or 95% of Bald ions having said third mass to charge ratio do not pass across said first potential.

20. A mass spectrometer as claimed in claim 16, wherein said one or more transient DC voltages or said one or more transient DC voltage waveforms and said second potential are such that at least 10%, 20%, 30%, 40%, 50%, 60%, 70%, 80%, 90% or 95% of said ions having said first mass to charge ratio pass across said second potential.

21. A mass spectrometer as claimed in claim 16, wherein said one or more transient DC voltages or said one or more transient DC voltage waveforms and said second potential are such that at least 10%, 20%, 30%, 40%, 50%, 60%, 70%, 80%, 90% or 95% of said ions having said second mass to charge ratio do not pass across said second potential.

22. A mass spectrometer as claimed in claim 16, wherein said one or more transient DC voltages or said one or more transient DC voltage waveforms are such that at least 10%, 20%, 30%, 40%, 50%, 60%, 70%, 80%, 90% or 95% of said ions having said second mass to charge ratio exit said mass filter substantially before ions having said first and third mass to charge ratios.

23. A mass spectrometer as claimed in claim 16, wherein said one or more transient DC voltages or said one or more transient DC voltage waveforms are such that at least 10%, 20%, 30%, 40%, 50%, 60%, 70%, 80%, 90% or 95% of said ions having said first and third mass to charge ratios exit said mass filter substantially after ions having said second mass to charge ratio.

24. A mass spectrometer as claimed in claim 16, wherein a majority of said ions having said second mass to charge ratio exit said mass filter a time t before a majority of said ions having said first and third mass to charge ratios exit said mass filter, wherein t falls within a range selected from the group consisting of: (i) <1 μs; (ii) 1–10 μs; (iii) 10–50 μs; (iv) 50–100 μs; (v) 100–200 μs; (vi) 200–300 μs; (vii) 300–400 μs; (viii) 400–500 μs; (ix) 500–600 μs; (x) 600–700 μs; (xi) 700–800 μs; (xii) 800–900 μs; (xiii) 900–1000 μs.

25. A mass spectrometer as claimed in claim 16, wherein a majority of said ions having said second mass to charge ratio exit said mass filter a time t before a majority of said ions having said first and third mass to charge ratios exit said mass filter, wherein t falls within a range selected from the group consisting of: (i) 1.0–1.5 ms; (ii) 1.5–2.0 ms; (iii) 2.0–2.5 ms; (iv) 2.5–3.0 ms; (v) 3.0–3.5 ms; (vi) 3.5–4.0 ms; (vii) 4.0–4.5 ms; (viii) 4.5–5.0 ms; (ix) 5–10 ms; (x) 10–15 ms; (xi) 15–20 ms; (xii) 20–25 ms; (xiii) 25–30 ms; (xiv) 30–35 ms; (xv) 35–40 ms; (xvi) 40–45 ms; (xvii) 45–50 ms; (xviii) 50–55 ms; (xix) 55–60 ms; (xx) 60–65 ms; (xxi) 65–70 ms; (xxii) 70–75 ms; (xxiii) 75–80 ms; (xxiv) 80–85 ms; (xxv) 85–90 ms; (xxvi) 90–95 ms; (xxvii) 95–100 ms; and (xxviii) >100 ms.

26. A mass spectrometer as claimed in claim 16, wherein said one or more transient DC voltages create: (i) a potential hill or barrier; (ii) a potential well; (iii) a combination of a potential hill or barrier and a potential well; (iv) multiple potential hills or barriers; (v) multiple potential wells; or (vi) a combination of multiple potential hills or barriers and multiple potential wells.

27. A mass spectrometer as claimed in claim 16, wherein said one or more transient DC voltage waveforms comprise a repeating waveform.

28. A mass spectrometer as claimed in claim 27, wherein said one or more transient DC voltage waveforms comprise a square wave.

29. A mass spectrometer as claimed in claim 16, wherein said one or more transient DC voltage waveforms create a plurality of potential peaks or wells separated by intermediate regions.

30. A mass spectrometer as claimed in claim 29, wherein the DC voltage gradient in said intermediate regions is zero or non-zero.

31. A mass spectrometer as claimed in claim 29, wherein said DC voltage gradient in said intermediate regions is positive or negative.

32. A mass spectrometer as claimed in claim 29, wherein the DC voltage gradient in said intermediate regions is linear.

33. A mass spectrometer as claimed in claim 29, wherein the DC voltage gradient in said intermediate regions is non-linear.

34. A mass spectrometer as claimed in claim 33, wherein said DC voltage gradient in said intermediate regions increases or decreases, exponentially.

35. A mass spectrometer as claimed in claim 29, wherein the amplitude of said potential peaks or wells remains substantially constant.

36. A mass spectrometer as claimed in claim 29, wherein the amplitude of said potential peaks or wells becomes progressively larger or smaller.

37. A mass spectrometer as claimed in claim 36, wherein the amplitude of said potential peaks or wells increases or decreases either linearly or non-linearly.

38. A mass spectrometer as claimed in claim 16, wherein in use an axial DC voltage gradient is maintained along at least a portion of the length of said mass filter and wherein said axial voltage gradient varies with time.

39. A mass spectrometer as claimed in claim 16, wherein said mass filter comprises a first electrode held at a first reference potentials a second electrode held at a second reference potentials and a third electrode held at a third reference potential, wherein:

at a first time $t_1$ a first DC voltage is supplied to said first electrode so that said first electrode is held at a first potential above or below said first reference potential;

at a second later time $t_2$ a second DC voltage is supplied to said second electrode so that said second electrode is held at a second potential above or below said second reference potential, and at a third later time $t_3$ a third DC voltage is supplied to said third electrode so that said third electrode is held at a third potential above or below said third reference potential.

40. A mass spectrometer as claimed in claim 39, wherein:

at said first time $t_1$ said second electrode is at said second reference potential and said third electrode is at said third reference potential;

at said second time $t_2$ said first electrode is at said first potential and said third electrode is at said third reference potential; and at said third time $t_3$ said first electrode is at said first potential and said second electrode is at said second potential.

41. A mass spectrometer as claimed in claim 39, wherein:

at said first time $t_1$ said second electrode is at said second reference potential and said third electrode is at said third reference potential;

at said second time $t_2$ said first electrode is no longer supplied with said first DC voltage so that said first electrode is returned to said first reference potential and said third electrode is at said third reference potential; and at said third time $t_3$ said first electrode is at said first reference potential said second electrode is no longer supplied with said second DC voltage so that said second electrode is returned to said second reference potential.

42. A mass spectrometer as claimed in claim 39, wherein said first, second and third reference potentials are substantially the same.

43. A mass spectrometer as claimed in claim 39, wherein said firsts second and third DC voltages are substantially the same.

44. A mass spectrometer as claimed in claim 39, wherein said first, second and third potentials are substantially the same.

45. A mass spectrometer as claimed in claim 16, wherein said mass filter comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19. 20, 21, 22, 23, 24, 25, 26, 27, 28, 29, 30 or >30 electrodes and wherein the electrodes in a segment are maintained at substantially the same DC potential.

46. A mass spectrometer as claimed in claim 45, wherein a plurality of segments are maintained at substantially the same DC potential.

47. A mass spectrometer as claimed in claim 45, wherein each segment is maintained at substantially the same DC potential as the subsequent nth segment wherein n is 3, 4, 5, 6, 7, 8, 9, 10, 11, 12, 13, 14, 15, 16, 17, 18, 19, 20, 21. 22, 23, 24, 25, 26, 27, 28, 29, 30 or >30.

48. A mass spectrometer as claimed in claim 16, wherein ions are radially confined within said mass filter in a pseudo-potential well and are moved axially by a real potential barrier or well.

49. A mass spectrometer as claimed in claim 16, wherein in use one or more AC or RF voltage waveforms are applied to at least some of said electrodes so that ions are urged along at least a portion of the length of said mass filter.

50. A mass spectrometer as claimed in claim 16, wherein the transit time of ions through said mass filter is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

51. A mass spectrometer as claimed in claim 16, wherein said mass filter is maintained, in use, at a pressure such that substantially no viscous drag is imposed upon ions passing through said mass filter.

52. A mass spectrometer as claimed in claim 16, wherein, in use, themean free path of ions passing through said mass filter is greater than the length of said mass filter.

53. A mass spectrometer as claimed in claim 16, wherein in use said one or more transient DC voltages or said one or more transient DC voltage waveforms are initially provided at a first axial position and are then subsequently provided at second, then third different axial positions along said mass filter.

54. A mass spectrometer as claimed in claim 16, wherein said one or more transient DC voltages or said one or more transient DC voltage waveforms move from one end of said mass filter to another end of said mass filter so that at least some ions are urged along said mass filter.

55. A mass spectrometer as claimed in claim 16, wherein said one or more transient DC voltages or said one or more transient DC voltage waveforms have at least 2, 3, 4, 5, 6, 7, 8, 9 or 10 different amplitudes.

56. A mass spectrometer as claimed in claim 16, wherein the amplitude of said one or more transient DC voltages or said one or more transient DC voltage waveforms remains substantially constant with time.

57. A mass spectrometer as claimed in claim 16, wherein the amplitude of said one or more transient DC voltages or said one or more transient DC voltage waveforms varies with time.

58. A mass spectrometer as claimed in claim 57, wherein the amplitude of said one or more transient DC voltages or said one or more transient DC voltage waveforms either: (i) increases with time; (ii) increases then decreases with time; (iii) decreases with time; or (iv) decreases then increases with time.

59. A mass spectrometer as claimed in claim 16, wherein said mass filter comprises an upstream entrance region, a downstream exit region and an intermediate region, wherein:

in said entrance region the amplitude of said one or more transient DC voltages or said one or more transient DC voltage waveforms has a first amplitude;

in said intermediate region the amplitude of said one or more transient DC voltages or said one or more transient DC voltage waveforms has a second amplitude; and in said exit region the amplitude of said one or more transient DC voltages or said one or more transient DC voltage waveforms has a third amplitude.

60. A mass spectrometer as claimed in claim 59, wherein the entrance and/or exit region comprise a proportion of the total axial length of said mass filter selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

61. A mass spectrometer as claimed in claim 59, wherein said first and/or third amplitudes are substantially zero and said second amplitude is substantially non-zero.

62. A mass spectrometer as claimed in claim 59, wherein said second amplitude is larger than said first amplitude and/or said second amplitude is larger than said third amplitude.

63. A mass spectrometer as claimed in claim 16, wherein said one or more transient DC voltages or said one or more transient DC voltage waveforms pass in use along said mass filter with a first velocity.

64. A mass spectrometer as claimed in claim 63, wherein said first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

65. A mass spectrometer as claimed in claim 63, wherein said one or more transient DC voltages or said one or more transient DC voltage waveforms causes some ions within said mass filter to pass along said mass filter with a second different velocity.

66. A mass spectrometer as claimed in claim 63, wherein said one or more transient DC voltages or said one or more transient DC voltage waveforms causes at least some ions within said mass filter to pass along said mass filter with a third different velocity.

67. A mass spectrometer as claimed in claim 63, wherein said one or more transient DC voltages or said one or more transient DC voltage waveforms causes at least some ions within said mass filter to pass along said mass filter with a fourth different velocity.

68. A mass spectrometer as claimed in claim 63, wherein said one or more transient DC voltages or said one or more transient DC voltage waveforms causes at least some ions within said mass filter to pass along said mass filter with a fifth different velocity.

69. A mass spectrometer as claimed in claim 63, wherein said second and/or said third and/or said fourth and/or said fifth velocity is at least 1, 5, 10, 15, 20, 25, 30, 35, 40, 45, 50, 55, 60, 65, 70, 75, 80, 85, 90, 95 or 100 m/s faster than said first velocity.

70. A mass spectrometer as claimed in claim 63, wherein said second and/or said third and/or said fourth and/or said fifth velocity is at least 1, 5, 10, 15, 20, 25, 30, 35, 40, 45, 50, 55, 60, 65, 70, 75, 60, 85, 90, 95 or 100 m/s slower than said first velocity.

71. A mass spectrometer as claimed in claim 63, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; (xxi) 5000–5250 m/s; (xxii) 5250–5500 m/s; (xxiii) 5500–5750 m/s; (xxiv) 5750–6000 m/s; and (xxv) >6000 m/s.

72. A mass spectrometer as claimed in claim 63, wherein said second and/or said third and/or said fourth and/or said fifth velocity are selected from the group consisting of: (i) 10–250 m/s; (ii) 250–500 m/s; (iii) 500–750 m/s; (iv) 750–1000 m/s; (v) 1000–1250m/s; (vi) 1250–1500 m/s; (vii) 1500–1750m/s; (viii) 1750–2000 m/s; (ix) 2000–2250m/s; (x) 2250–2500m/s; (xi) 2500–2750 m/s; (xii) 2750–3000m/s; (xiii) 3000–3250 m/s; (xiv) 3250–3500 m/s; (xv) 3500–3750m/s; (xvi) 3750–4000 m/s; (xvii) 4000–4250 m/s; (xviii) 4250–4500 m/s; (xix) 4500–4750 m/s; (xx) 4750–5000 m/s; (xxi) 5000–5250 m/s; (xxii) 5250–5500 m/s; (xxiii) 5500–5750 m/s; (xxiv) 5750–6000 m/s; and (xxv) >6000 m/s.

73. A mass spectrometer as claimed in claim 16, wherein said one or more transient DC voltages or said one or more transient DC voltage waveforms has a frequency, and wherein said frequency: (i) remains substantially constant; (ii) varies; (iii) increases; (iv) increases then decreases; (v) decreases; or (vi) decreases then increases.

74. A mass spectrometer as claimed in claim 16, wherein said one or more transient DC voltages or said one or more transient DC voltage waveforms has a wavelength, and wherein said wavelength: (i) remains substantially constant; (ii) varies; (iii) increases; (iv) increases then decreases; (v) decreases; or (vi) decreases then increases.

75. A mass spectrometer as claimed in claim 16, wherein two or more transient DC voltages or two or more transient DC voltage waveforms pass simultaneously along said mass filter.

76. A mass spectrometer as claimed in claim 75, wherein said two or more transient DC voltages or said two or more transient DC voltage waveforms are arranged to move: (i) in the same direction; (ii) in opposite directions; (iii) towards each other; or (iv) away from each other.

77. A mass spectrometer as claimed in claim 16, wherein said one or more transient DC voltages or said one or more transient DC voltage waveforms passes along said mass filter and at least one substantially stationary transient DC potential voltage or voltage waveform is provided at a position along said mass filter.

78. A mass spectrometer as claimed in claim 16, wherein said one or more transient DC voltages or said one or more transient DC voltage waveforms are repeatedly generated and passed in use along said mass filter, and wherein the frequency of generating said one or more transient DC voltages or said one or more transient DC voltage waveforms: (i) remains substantially constant; (ii) varies; (iii) increases; (iv) increases then decreases; (v) decreases; or (vi) decreases then increases.

79. A mass spectrometer as claimed in claim 16, wherein in use a continuous beam of ions is received at an entrance to said mass filter.

80. A mass spectrometer as claimed in claim 16, wherein in use packets of ions are received at an entrance to said mass filter.

81. A mass spectrometer as claimed in claim 16, wherein in use pulses of ions emerge from an exit of said mass filter.

82. A mass spectrometer as claimed in claim 81, further comprising an ion detector, said ion detector being arranged to be substantially phase locked in use with the pulses of ions emerging from the exit of the mass filter.

83. A mass spectrometer as claimed in claim 81, further comprising a Time of Plight mass analyser comprising an electrode for injecting ions into a drift region, said electrode being arranged to be energised in use in a substantially synchronised manner with the pulses of ions emerging from the exit of the mass filter.

84. A mass spectrometer as claimed in claim 16, wherein said mass filter is selected from the group consisting of: (i) an ion funnel comprising a plurality of electrodes having apertures therein through which ions are transmitted in use, wherein the diameter of said apertures becomes progressively smaller or larger; (ii) an ion tunnel comprising a plurality of electrodes having apertures therein through which ions are transmitted in use, wherein the diameter of said apertures remains substantially constant; and (iii) a stack of plate, ring or wire loop electrodes.

85. A mass spectrometer as claimed in claim 16, wherein said mass filter comprises a plurality of electrodes, each electrode having an aperture through which ions are transmitted in use.

86. A mass spectrometer as claimed in claim 16, wherein each electrode has a substantially circular aperture.

87. A mass spectrometer as claimed in claim 16, wherein each electrode has a single aperture through which ions are transmitted in use.

88. A mass spectrometer as claimed in claim 85, wherein the diameter of the apertures of at least 10%, 20%, 30%, 40%, 50%, 60%, 70%, 80%, 90% or 95% of the electrodes forming said mass filter is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

89. A mass spectrometer as claimed in claim 16, wherein at least 10%, 20%, 30%, 40%, 50%, 60%, 70%, 80%, 90% or 95% of the electrodes forming the mass filter have apertures which are substantially the same size or area.

90. A mass spectrometer as claimed in claim 16, wherein said mass filter comprises a segmented rod set.

91. A mass spectrometer as claimed in claim 16, wherein said mass filter consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 60–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; (xv) more than 150 electrodes; or (xvi) $\geqq$15 electrodes.

92. A mass spectrometer as claimed in claim 16, wherein the thickness of at least 10%, 20%, 30%, 40%, 50%, 60%, 70%, 80%, 90% or 95% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

93. A mass spectrometer as claimed in claim 16, wherein said mass filter has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

94. A mass spectrometer as claimed in claim 16, wherein at least 10%, 20%, 30%, 40%, 50%, 60%, 70%, 80%, 90%, or 95% of said electrodes are connected to both a DC and an AC or RF voltage supply.

95. A mass spectrometer as claimed in. claim 16, wherein axially adjacent electrodes are supplied with AC or RF voltages having a phase difference of 180°.

96. A mass spectrometer as claimed in claim 16, further comprising an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI) ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

97. A mass spectrometer as claimed in claim 16, further comprising a continuous ion source.

98. A mass spectrometer as claimed in claim 16, further comprising a pulsed ion source.

99. A mass filter for separating ions according to their mass to charge ratio, said mass filter comprising at least seven electrodes wherein, in use, an AC or RF voltage is applied to said electrodes in order to radially confine ions within said mass filter and wherein in use one or more transient DC voltages or one or more transient DC voltage waveforms are progressively applied to said electrodes so that at least some ions having a first mass to charge ratio are separated from other ions having a second different mass to charge ratio which remain substantially radially confined within said mass filter.

100. A mass filter for separating ions according to their mass to charge ratio, said mass filter comprising at least seven electrodes wherein, in use, an AC or RF voltage is applied to said electrodes in order to radially confine ions within said mass filter and wherein in use one or more transient DC voltages or one or more transient DC voltage waveforms are progressively applied to said electrodes so that ions are moved towards a region of the mass filter wherein at least one electrode has a potential such that at least some ions having a first mass to charge ratio will pass across said potential whereas other ions having a second different mass to charge ratio will not pass across said potential but will remain substantially radially confined within said mass filter.

101. A mass filter for separating ions according to their mass to charge ratio, said mass filter comprising a plurality of electrodes wherein, in use, an AC or RF voltage is applied to said electrodes in order to radially confine ions within said mass filter and wherein in use one or more transient DC voltages or one or more transient DC voltage waveforms are progressively applied to said electrodes so that:

(i) ions are moved towards a region of the mass filter wherein at least one electrode has a first potential such that at least some ions having first and second different mass to charge ratios will pass across said first potential whereas other ions having a third different mass to charge ratio will not pass across said first potential; and then (ii) ions having said first and second mass to charge ratios are moved towards a region of the mass filter wherein at least one electrode has a second potential such that at least some ions having said first mass to charge ratio will pass across said second potential whereas other ions having said second different mass to charge ratio will not pass across said second potential.

102. A method of mass spectrometry comprising:

receiving ions in a mass filter comprising at least seven electrodes wherein an AC or RF voltage is applied to said electrodes in order to radially confine ions within said mass filter; and progressively applying to said electrodes one or more transient DC voltages or one or more transient DC voltage waveforms so that at least some ions having a first mass to charge ratio are separated from other ions having a second different mass to charge ratio which remain substantially radially confined within said mass filter.

103. A method of mass spectrometry comprising:

receiving ions in a mass filter comprising at least seven electrodes wherein an AC or RF voltage is applied to said electrodes in order to radially confine ions within said mass filter; and progressively applying to said electrodes one or more transient DC voltages or one or more transient DC voltage waveforms so that ions are moved towards a region of the mass filter wherein at least one electrode has a potential such that at least some ions having a first mass to charge ratio will pass across said potential whereas other ions having a second different mass to charge ratio will not pass across said potential but will remain substantially radially confined within said mass filter.

104. A method of mass spectrometry comprising:

receiving ions in a mass filter comprising a plurality of electrodes wherein an AC or RF voltage is applied to said electrodes in order to radially confine ions within said mass filter;

progressively applying to said electrodes one or more transient DC voltages or one or more transient DC voltage waveforms so that ions are moved towards a region of the mass filter wherein at least one electrode has a first potential such that at least some ions having a first and second different mass to charge ratios will pass across said first potential whereas other ions having a third different mass to charge ratio will not pass across said first potential; and then progressively applying to said electrodes one or more transient DC voltages or one or more transient DC voltage waveforms so that ions having said first and second mass to charge ratios are moved towards a region of the mass filter wherein at least one electrode has a second potential such that at least some ions having said first mass to charge ratio will pass across said second potential whereas other ions having said second different mass to charge ratio will not pass across said second potential.

105. A method of mass to charge ratio separation comprising:

receiving ions in a mass filter comprising at least seven electrodes wherein an AC or RF voltage is applied to said electrodes in order to radially confine ions within said mass filter; and progressively applying to said electrodes one or more transient DC voltages or one or more transient DC voltage waveforms so that at least some ions having a first mass to charge ratio are separated from other ions having a second different mass to charge ratio which remain substantially radially confined within said mass filter.

106. A method of mass to charge ratio separation comprising:

receiving ions in a mass filter comprising at least seven electrodes wherein an AC or RF voltage is applied to said electrodes in order to radially confine ions within said mass filter; and progressively applying to said electrodes one or more transient DC voltages or one or more transient DC voltage waveforms so that ions are moved towards a region of the mass filter wherein at least one electrode has a potential such that at least some ions having a first mass to charge ratio will pass across said potential whereas other ions having a second different mass to charge ratio will not pass across said potential but will remain substantially radially confined within said mass filter.

107. A method of mass to charge ratio separation comprising:

receiving ions in a mass filter comprising a plurality of electrodes wherein an AC or RF voltage is applied to said electrodes in order to radially confine ions within said mass filter;

progressively applying to said electrodes one or more transient DC voltages or one or more transient DC voltage waveforms so that ions are moved towards a region of the mass filter wherein at least one electrode has a first potential such that at least some ions having a first and second different mass to charge ratios will pass across said first potential whereas other ions having a third different mass to charge ratio will not pass across said first potential; and then progressively applying to said electrodes one or more transient DC voltages or one or more transient DC voltage waveforms so that ions having said first and second mass to charge ratios are moved towards a region of the mass filter wherein at least one electrode has a second potential such that at least some ions having said first mass to charge ratio will pass across said second potential whereas other ions having said second different mass to charge ratio will not pass across said second potential.

108. A mass filter wherein ions separate within said mass filter according to their mass to charge ratio and assume different essentially static or equilibrium axial positions along the length of said mass filter wherein said mass filter comprises a plurality of electrodes wherein, in use, an AC or RF voltage is applied to said electrodes in order to radially confine ions with said mass filter.

109. A mass filter as claimed in claim 108, wherein one or more transient DC voltages or one or more transient DC voltage waveforms are progressively applied to said electrodes so as to urge at least some ions in a first direction.

110. A mass filter as claimed in claim 109, wherein a DC voltage gradient acts to urge at least some ions in a second direction, said second direction being opposed to said first direction.

111. A mass filter as claimed in claim 109, wherein the peak amplitude of said one or more transient DC voltages or said one or more transient DC voltage waveforms remains substantially constant or reduces along the length of the mass filter.

112. A mass filter as claimed in claim 110, wherein said DC voltage gradient progressively increases along the length of the mass filter.

113. A mass spectrometer comprising a mass filter as claimed in claim 108.

114. A mass filter wherein ions separate within said mass filter according to their mass to charge ratio and assume different essentially static or equilibrium axial positions along the length of said mass filter, wherein once ions have assumed essentially static or equilibrium axial positions along the length of said mass filter at least some of said ions are then arranged to be moved towards an exit of said mass filter.

115. A mass filter as claimed in claim 114, wherein at least some of said ions are arranged to be moved towards an exit of said mass filter by: (i) reducing or increasing an axial DC voltage gradient; (ii) reducing or increasing the peak amplitude of one or more transient DC voltages or one or more transient DC voltage waveforms; (iii) reducing or increasing the velocity of one or more transient DC voltages or one or more transient DC voltage waveforms; or (iv) reducing or increasing the pressure within said mass filter.

116. A method of mass to charge ratio separation comprising causing ions to separate within a mass filter and assume different essentially static or equilibrium axial positions along the length of the mass filter wherein said mass filter comprises a plurality of electrodes wherein, in use, an AC or RF voltage is applied to said electrodes in order to radially confine ions with said mass filter.

117. A method of mass to charge ratio separation as claimed in claim 116, wherein one or more transient DC voltages or one or more transient DC voltage waveforms are progressively applied to said electrodes so as to urge at least some ions in a first direction.

118. A method of mass to charge ratio separation as claimed in claim 117, wherein a DC voltage gradient acts to urge at least some ions in a second direction, said second direction being opposed to said first direction.

119. A method of mass to charge ratio separation as claimed in claim 117, wherein the peak amplitude of said one or more transient DC voltages or said one or more transient DC voltage waveforms remains substantially constant or reduces along the length of the mass filter.

120. A method of mass to charge ratio separation as claimed in claim 118, wherein said DC voltage gradient progressively increases along the length of the mass filter.

121. A method of mass spectrometry comprising the method of mass to charge ratio separation as claimed in claim 116.

122. A method of mass to charge ratio separation comprising causing ions to separate within a mass filter and assume different essentially static of equilibrium axial positions along the length of the mass filter, wherein once ions have assumed essentially static or equilibrium axial positions along the length of said mass filter at least some of said ions are then arranged to be moved towards an exit of mass filter.

123. A method of mass to charge ratio separation as claimed in claim 122, wherein at least some of said ions are arranged to be moved towards an exit of said mass filter by: (i) reducing or increasing an axial DC voltage gradient; (ii) reducing or increasing the peak amplitude of one or more transient DC voltages or one or more transient DC voltage waveforms: (iii) reducing or increasing the velocity of one or more transient DC voltages or one or more transient DC voltage waveforms; or (iv) reducing or increasing the pressure within said mass filter.

* * * * *